United States Patent [19]

Kobayashi

[11] Patent Number: 4,642,591

[45] Date of Patent: Feb. 10, 1987

[54] TM-MODE DIELECTRIC RESONANCE APPARATUS

[75] Inventor: Yoshio Kobayashi, Oomiya, Japan

[73] Assignee: Murata Manufacturing Co., Ltd., Japan

[21] Appl. No.: 770,965

[22] Filed: Aug. 30, 1985

[30] Foreign Application Priority Data

Nov. 16, 1984 [JP] Japan ..... 59-243090

[51] Int. Cl.[4] ..... H01P 1/219; H01P 7/10

[52] U.S. Cl. ..... 333/227; 333/210; 333/230; 333/232

[58] Field of Search ..... 333/202, 204–212, 333/219, 222, 227–232, 234–235, 246, 248, 245; 331/96, 107 DP, 176

[56] References Cited

U.S. PATENT DOCUMENTS 4,489,293 12/1984 Fiedziuszko ..... 333/202

*Primary Examiner*—Marvin L. Nussbaum

*Attorney, Agent, or Firm*—Ostrolenk, Faber, Gerb & Soffen

[57] ABSTRACT

A dielectric resonance apparatus for resonating in a TM mode such as TM 110 or the like. The apparatus includes a case having therein at least two TM-mode dielectric resonators, these resonators being oriented in the case so that their magnetic fields intersect each other. The apparatus also comprises means for coupling the magnetic fields. The TM-mode dielectric resonators may be integrally or separately formed. Each adjacent pair of resonators may be magnetically interconnected by an irregularly shaped portion of the case, such as a depressed portion or a projecting portion, for influencing the respective magnetic fields of each resonator by a selected degree, such that different respective degrees of influence are obtained with respect to the even and odd modes to be produced by the two resonators. The apparatus may include a third dielectric resonator which is closer to the second resonator than to the first resonator, the first and the third resonators being magnetically connected to provide polarized band-pass characteristics. The respective lengths of the first and second resonators may be made different so as to change the degree of magnetic connection between the first and third resonators.

21 Claims, 33 Drawing Figures

TM-MODE DIELECTRIC RESONANCE APPARATUS

BACKGROUND OF THE INVENTION

The present invention generally relates to a resonance apparatus using a TM mode such as TM110 or the like.

An example of the prior art filter is provided wherein TM110 square-pillar dielectric resonators R1, R2, R3, R4 with their axial lines being within the same plane and being parallel to each other are fixedly disposed within a case operating as a cut-off waveguide as shown in FIG. 29. The respective both end faces of the resonators R1 through R4 are in close contact against the inner faces of the case 1. Both a dipole 2 for inputting use and a dipole 3 for outputting use are connected with a coaxial circuit.

Thus, the prior art filter of such construction as described hereinabove requires resonator spaces in accordance with the coupling factors of the respective stages. Accordingly, there are limitations in rendering the size smaller. Also, it is difficult to provide the characteristics of having attenuation poles.

SUMMARY OF THE INVENTION

Accordingly, an essential object of the present invention is to render smaller a resonance apparatus such as filter using TM mode.

Another important object of the present invention is to easily provide the filter characteristics having the attenuation poles in a filter using the TM mode.

In accomplishing these objects, according to one preferred embodiment of the present invention, there is provided a filter, wherein at least two dielectric resonance portions are provided within the case so that the respective modes may intersect each other and both modes are coupled by a proper method.

By the arrangement according to the present invention as described above, an improved filter has been advantageously presented. Thus, since the coupling factors among the respective resonators be smaller as compared with the prior art filter wherein the square-pillar dielectric resonators with their axial lines being within the same plane and being parallel to each other are fixedly disposed within a case, the adjacent resonators may be brought into further contact against each other or be integrated with each other so as to render the size smaller. And the respective resonators may be brought into closer contact against each other so that filters having attenuation poles may be easily provided.

BRIEF DESCRIPTION OF THE DRAWINGS

These and other objects and features of the present invention will become apparent from the following description taken in conjunction with the preferred embodiment thereof with reference to the accompanying drawings, in which:

FIG. 27 is an interior view showing an embodiment, in which a waveguide is connected with;

DETAILED DESCRIPTION OF PREFERRED EMBODIMENTS OF THE INVENTION

Figure 1:
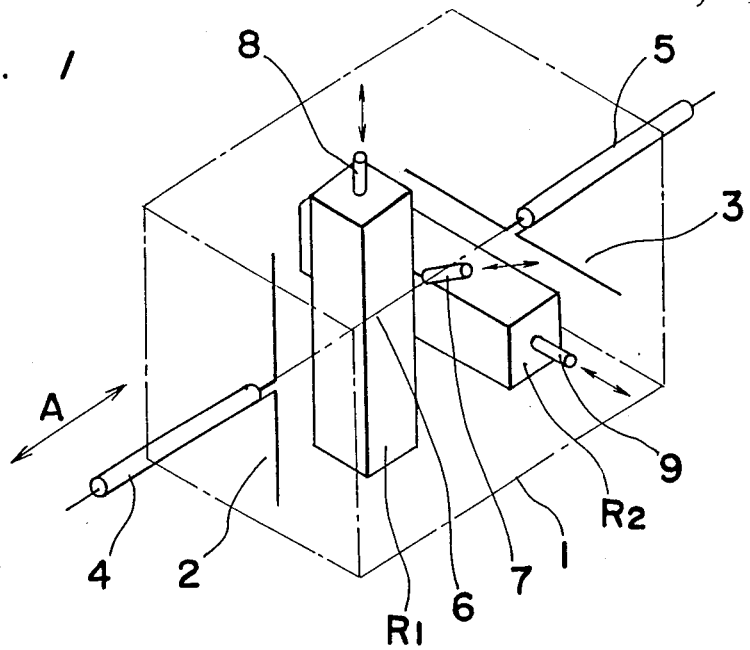
FIG. 1 is a schematic perspective view in one embodiment of the present invention.
Figure 2:
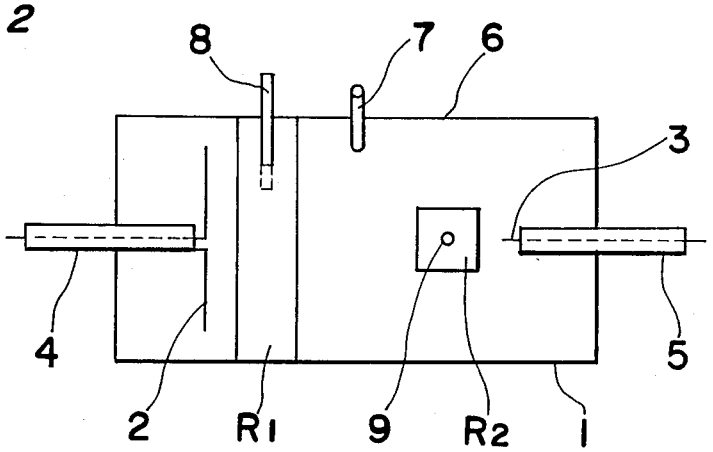
FIG. 2 is a schematic front-face view thereof.
Figure 3:
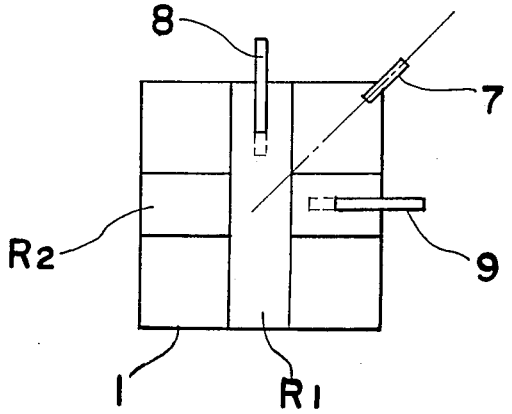
FIG. 3 is a schematic side-face view thereof.
Figure 4:
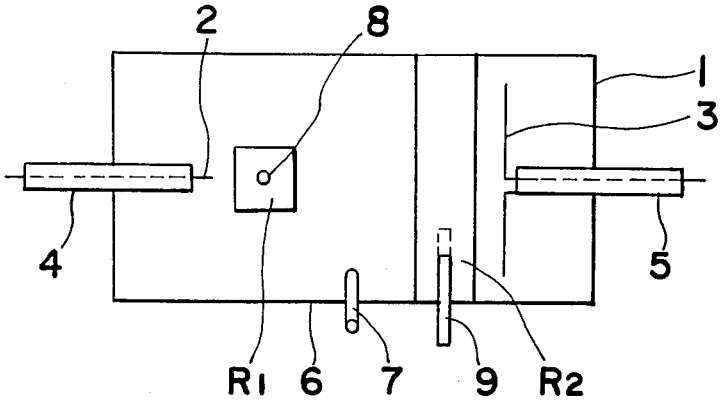
FIG. 4 is a schematic plan view thereof.

Before the description of the present invention proceeds, it is to be noted that like parts are designated by like reference numerals throughout the accompanying drawings.

Referring now to the drawings, there is shown in FIGS. 1 through 4 an embodiment of the basic construction of the present invention.

The resonator R1 and the resonator R2 which are respectively made of ceramic dielectric are characterized in that their axial lines are crossed at right angles to each other when they are seen from the input, output direction A. Both end faces of the resonators R1 and R2 are in close contact against the inner faces of the case 1. A resonator R1 of an initial stage is excited to vibrate by an input signal having been transmitted through a coaxial cable 4 so as to radiate from the dipole 2 as an electromagnetic wave. And the resonance of the TM110 mode is caused. The degeneration TM011 mode of the resonator R2 is coupled to the TM110 mode by a metal screw 7 thrust into the case 1 from the edge 6 of the case 1 (which functions as a cut-off waveguide), which is formed by metal or may be constructed to form a shielding conductive membrane on, for example, a ceramic material having a thermal expansion coefficient the same as or similar to that of the metal or the resonator. An angle formed by the screw 7 and the axial direction of the resonator is desired to be 45° when the resonators are crossed at a right angle to each other from a point of view that the same influences are applied upon both of the modes, but is not restricted to 45°. The TM011 mode of the resonator R2 is caught by the dipole 3 and is drawn out as an output out of the case 1 by the coaxial cable 5. Metallic screws 8, 9 for regulating the frequency are respectively inserted into the resonators R1, R2 from the outside of the case 1. The metallic screws 7, 8, 9 may be replaced by dielectric screws.

Figure 5:
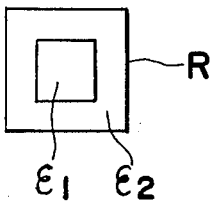
FIGS. 5 and 6 show the cross-sectional views of a resonator example.
Figure 6:
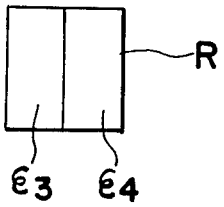
Figure 7:
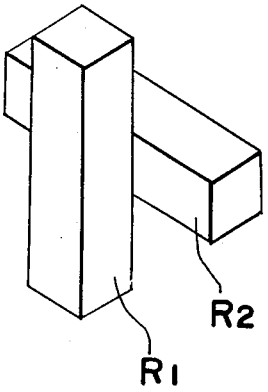
FIG. 7 is a perspective view showing the arranging condition example of the resonator.
Figure 8:
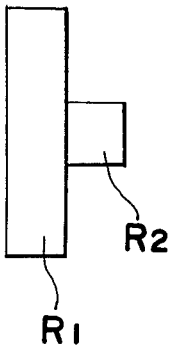
FIG. 8 is a side face view thereof.
Figure 9:
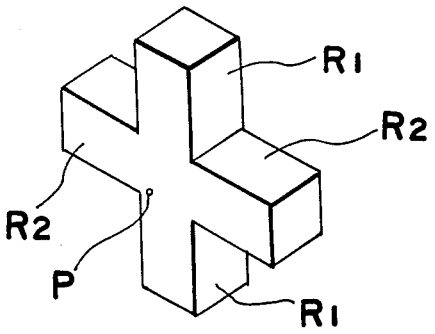
FIG. 9 is a perspective view of the resonator example.

Since the TM mode is used in present invention, the resonators are not restricted to the above-described square pillar, but may be cylindrical, elliptical, columnar or the like. Any shapes will do if the TM mode may be used. Also, as shown in FIG. 5, in the construction of the resonator, the portion of the dielectric constant $\epsilon 1$ may be surrounded in the section by the portion of the dielectric constant $\epsilon 2$ different from it. Or, as shown in FIG. 6, the portions of the mutually different dielectric constants $\epsilon 3$, $\epsilon 4$ may be posted. And the dielectric constants may be rendered different not only in the cross-sectional direction, but also in the axial direction as described hereinabove. In the embodiment, a uniform dielectric constant such as $\epsilon r = 37.9$ was used. Although the spurious characteristics of the TM111 mode or the like may be somewhat inferior, the resonators R1, R2 may be brought into close contact against each other as shown in FIG. 7, FIG. 8 or be provided in an integrated cross shape as shown in FIG. 9 so that the smaller size may be promoted in the input, output direction A. In this case, a coupling hole P is bored in an asymmetrical position to render the spurious response smaller.

Figure 10:
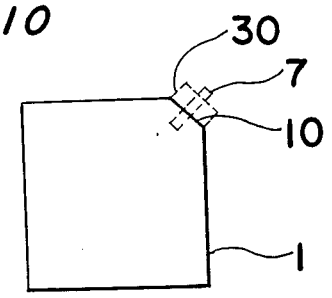
FIG. 10 is a view showing a case section example.
Figure 11:
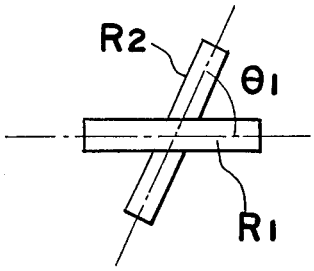
FIGS. 11 through 13 are views showing the arranging condition of the resonators.
Figure 12:
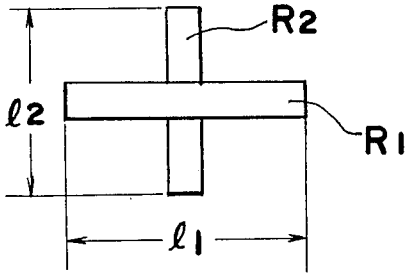
Figure 13:
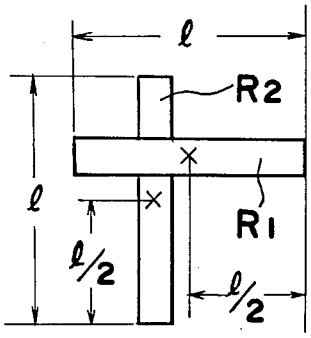
Figure 14:
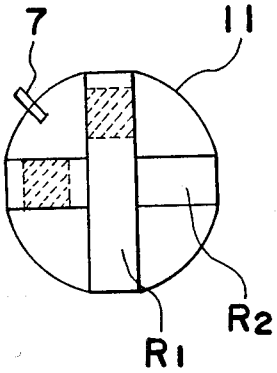
FIGS. 14 through 16 are views showing the combination examples in shape among the resonator sections and the cases.
Figure 15:
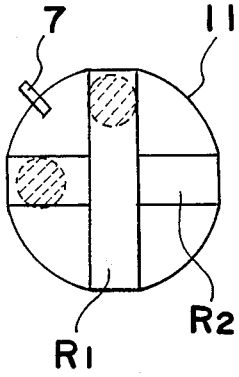
Figure 16:
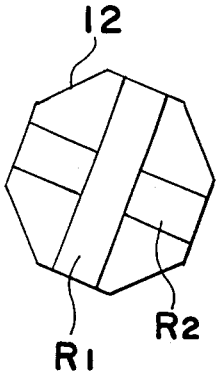
Figure 30:
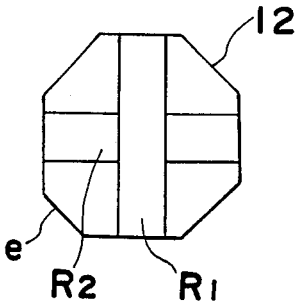
FIGS. 30 through 32 are views each showing the case shape.
Figure 31:
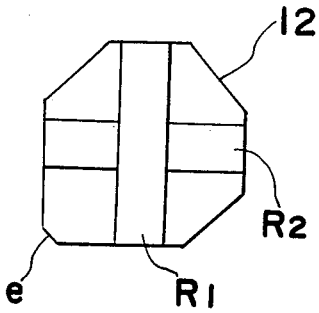
Figure 32:
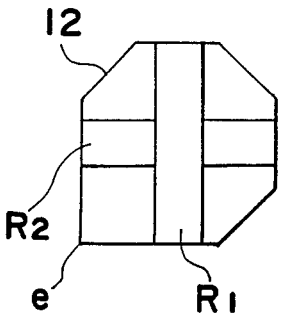

FIGS. 10 through 13 show the various examples of the connection construction of the resonators R1, R2. FIG. 10 is an example wherein an angle-removed portion 10 is provided on the edge 6 of the case 1. The angle-removed portion 10 achieves the connection between the resonators R1 and R2 by the same function as that of the screw 7, i.e., by making different the influences degree applied through the resonators R1, R2 upon the odd, even modes. It is to be noted that a portion 30 projected in the external direction of the case as shown in a dotted line may be formed instead of the angle-removed portion. Also, the screw 7 may be used, when necessary, chiefly for fine adjustment. The construction of FIG. 10 is preferable because of less Q reduction as compared with a case where only the screw 7 is used. FIG. 11 shows an example wherein an intersecting angle $\theta 1$ between the resonators R1 and R2 changes so as to change the coupling coefficient. FIG. 12 shows an example in which the resonators R1 and R2 are coupled to each other with their axial lengths l1 and l2 being made different. FIG. 13 shows an example in which they are coupled to each other with their intersecting portions being slid from their respective centers. Even in these embodiments, they may be integrally formed. FIGS. 14 through 16 show one portion of a modified embodiment with the resonator and the case being respectively made different in shape. FIG. 14 is an embodiment in which a cylindrical case 11 is used in the square-pillar resonator, both end faces of the resonator are in close contact against and on the whole face with respect to the case inner wall face. FIG. 15 is an example using a cylindrical case 11 in a columnar resonator (which uses a TM010 mode). FIG. 16 shows the combination of a columnar or square-pillar resonator with an octagonal case 12 which is one example of a polygon case. As described hereinabove, any resonator which used the TM mode will do and the case may be circular, square or the like in sectional shape. Also, in a case which is polygonal in such a section as that of FIG. 16, a coupling screw may be used, but at least one side may be deformed to realize the connection between the intersecting resonators. For example, the length of a side e represented on the section is variably changed so as to change the coupling degree, as shown in FIGS. 30 to 32.

Figure 17:
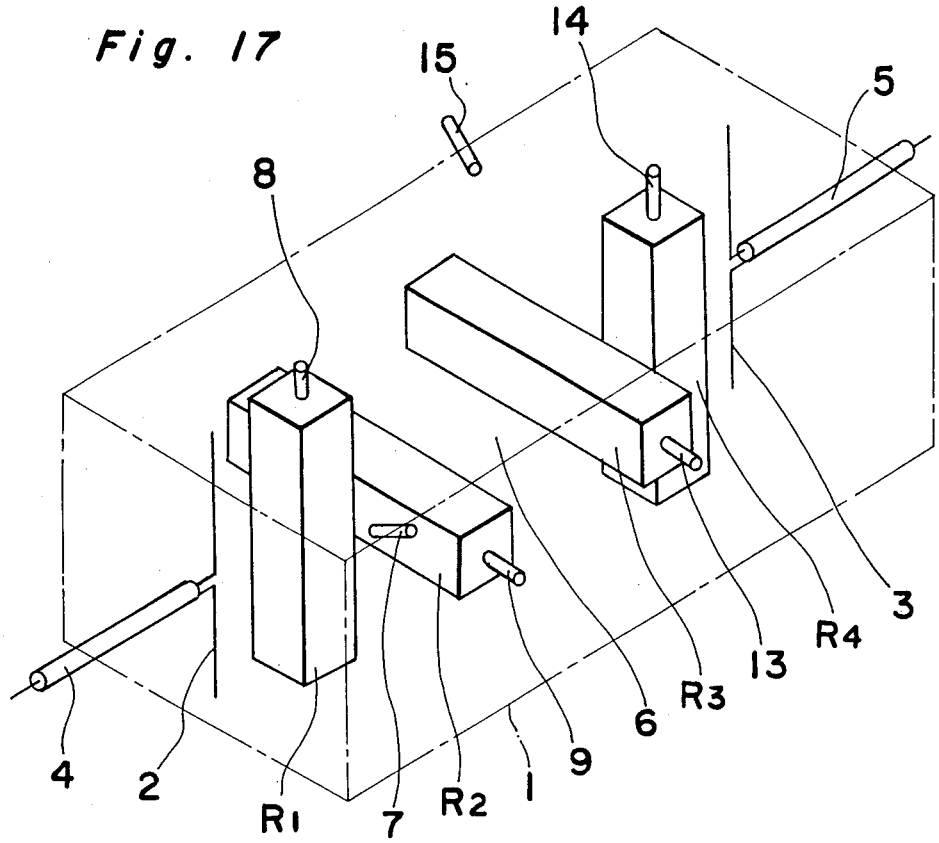
FIG. 17 is a schematic perspective view in one embodiment of the present invention.

FIG. 17 shows one example of a filter which is provided with polarized band passing characteristics. This example shows that the resonators R3, R4 and the screws 13, 14, 15 accompanied by them are added in the construction of FIGS. 1 through 4. The relationship between the resonators R3 and R4 is similar to that between the resonators R1 and R2. The screw 13, the screw 14 and the screw 15 respectively correspond to the screw 9, the screw 8 and the screw 7. The resonators R2, R3 are positioned within the same plane as before and are magnetically coupled to each other. The screw 15 is engaged into the case 1 from the side of the edge 16 opposite to the edge 6 of the case 1. The respective both end faces of the respective resonators R1 through R4 are in close contact against the inner face of the case 1. Thus, the polarized characteristics are provided. In this instance, when the sectional shape of the case 1 is rendered rectangular so that the directions conforming to the axial directions of the resonators R2, R3 are longer as shown, the connection between the resonators R1, R2 becomes stronger than in the instance of the square in section. Furthermore, when the space between the resonators R2 and R3 becomes shorter, the connection between the resonator R1 and R4 becomes stronger, because the space between the resonators R1, R2 and the space between the resonators R3, R4 are commonly retained at an approximately constant value. Therefore, the band passing characteristics which are strongly polarized are provided. As the TM110 dielectric square-pillar resonator does not change in the resonance frequency even if the length of the electric field direction is changed, the length of the case side along the directions conforming to the axial directions of the resonators R2, R3 is changed to change the cut-off frequency so as to regulate the connection amount so that the connection coefficient between the resonators R1 and R2 may be changed while the connection coefficient between the resonators R2 and R3 is being retained. Also, in order to shorten the length of the case side in the direction conforming to the axial direction of the resonators R1, R4 to render higher the cut-off frequency of the TE01 mode of a rectangular waveguide case so as to provide the connection amount equal to that before the length of the case side is rendered shorter, the space between the resonators R2 and R3 is rendered shorter so that the space between the resonators R4 and R2 becomes shorter to improve the connection degree. The connection degree except for the connection between the adjacent resonant portions is changed by the sectional shape of the case 1 so that the optional band passing characteristics are provided.

Figure 18:
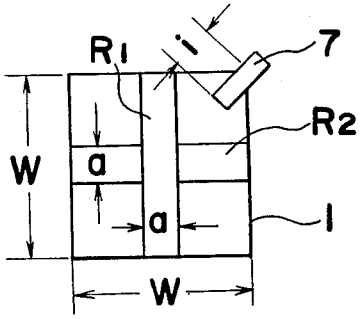
FIG. 18 is a view showing the case interior seen from the side face of an embodiment, whose size reference characters are described.
Figure 19:
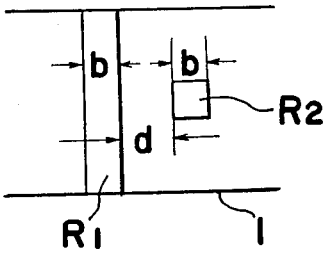
FIG. 19 is a view showing the case interior seen from the front face thereof.
Figure 20:
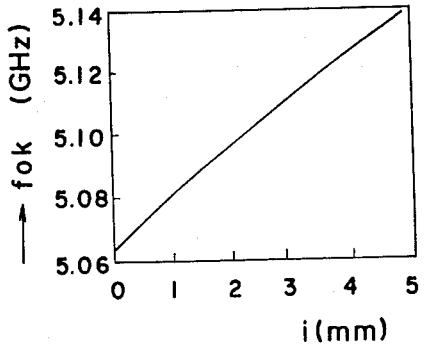
FIG. 20 is a chart showing the relationship between the insertion length of a screw 7 and the central frequency.
Figure 21:
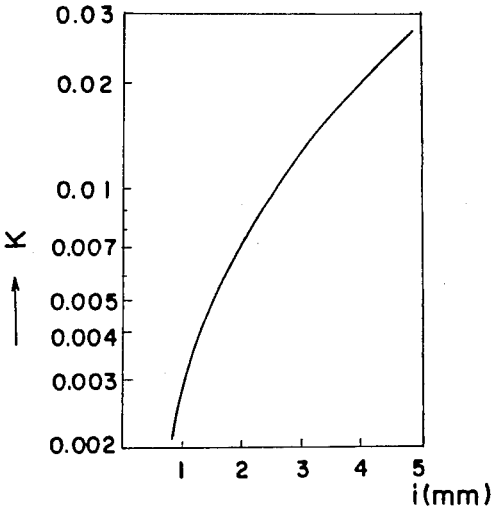
FIG. 21 is a chart showing the relationship between the insertion length of the screw 7 and a coupling factor.
Figure 23:
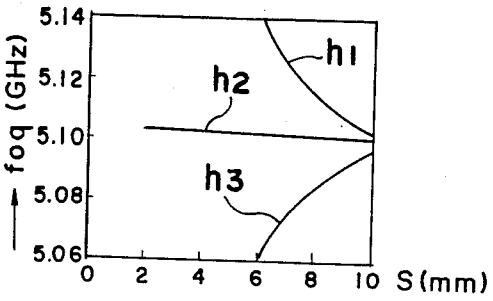
FIG. 23 is a chart showing the relationship between the dipole-resonator gap s and the resonance frequency with the dipole tip-end bent length h being provided as a parameter.
Figure 22:
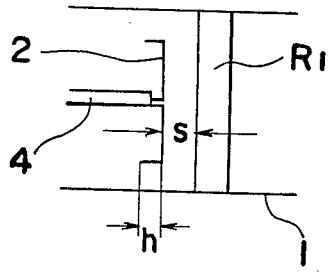
FIG. 22 is an interior view of the embodiment showing the condition between the dipole and the resonator.
Figure 24:
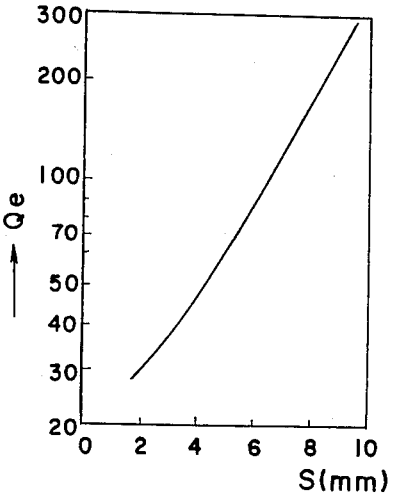
FIG. 24 is a chart showing the relationship between the gap s and the external Q.

The detailed construction of the filter of FIG. 17 will be described hereinafter. As the high order mode TM111 lowers when the gaps d of the dielectrics between the resonators R1 and R2, the resonators R3 and R4 become closer to zero as described hereinabove, the value of the gap d has been set to be away by one octave from the TM110 mode. Under this condition, FIGS. 20 and 21 respectively show the measured results of the central frequency fok and the connection coefficient k with respect to the insertion length i of the screw 7 in this condition. Such measured results are provided in the resonator dielectric constant $\epsilon r=37.9$, $a/w=0.250$ in FIG. 18, $a/b=1.00$ in FIGS. 18 and 19. It is to be noted that the combination coefficient necessary between the resonators R2 and R3 is obtained by a mode expansion method. The measured result of the external Q(Qe) is shown in FIG. 24. The tip end of the dipole 2 is bent, in a direction away from the resonator R1, in parallel relation to the wall face of the case 1 to grasp Teflon (Trade name) against the case for fixed insulation. The length h of the bent tip end portion has been determined to be $h2=1.1$ mm, which is least varied in frequency (this is because the dipole becomes resonant and the impedance has become pure in resistance) because of the measured result (FIG. 23) of the resonance frequency foq with respect to the distance S between the dielectric R1 and the dipole 2. It is to be noted that $h1=1.3$ mm and $h3=0.8$ mm in the drawing.

Figure 25:
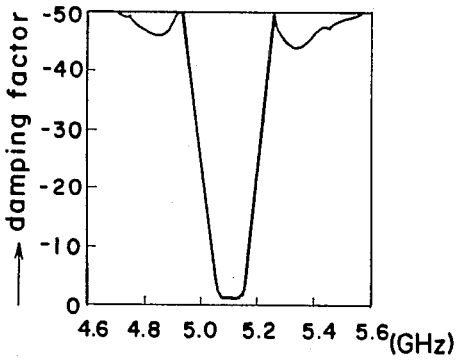
FIG. 25 is an attenuation characteristic view of a filter in one embodiment.

The measured result of the external portion Q shown in FIG. 24 is one with respect to S at this time. A filter of the central frequency $fo=5.10$ GHz, 3 dB band width $\Delta f=102$ MHz is designed by the use of the values determined hereinabove. FIG. 25 shows the measured results of the attentuation characteristics. The polarized characteristics are provided, which have the attenuation poles in 4.98 GHz and 5.21 GHz. The insertion loss is 1.0 dB.

Figure 26:
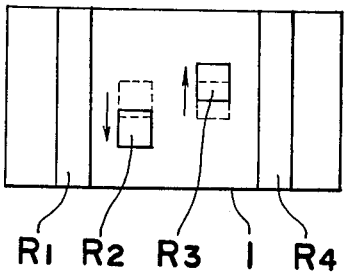
FIG. 26 is an interior view showing a resonator arrangement example.
Figure 33:
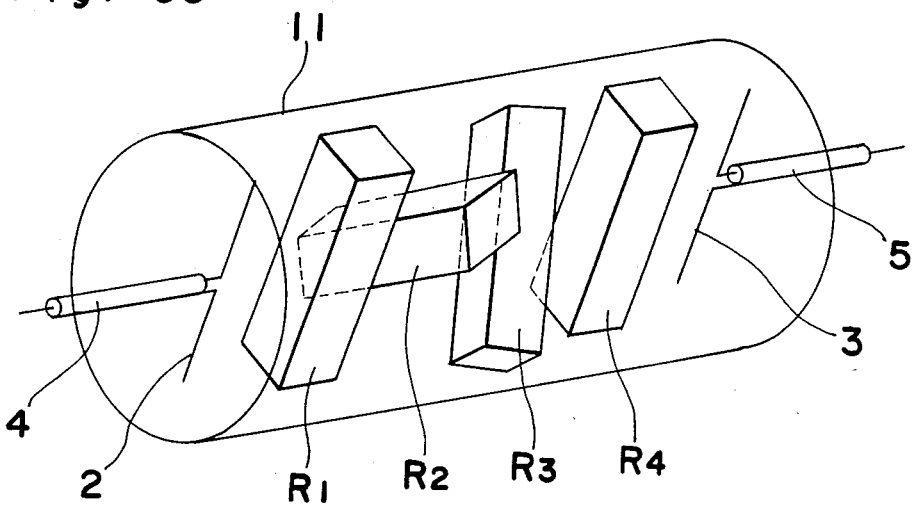
FIG. 33 is a view showing the arranging condition of the resonator.

FIG. 26 shows one example in which the connection coefficient between the resonators R2 and R3 changes. The resonators R2 and R3 are slid in the directions separating mutually from the normal positions (which are shown in dotted lines) and are fixedly arranged. Thus, as the connection coefficient becomes smaller, the case length of the input, output direction can be rendered shorter than when the resonators have been fixedly arranged in the ordinary positions, because of closer approaching operation of both the resonators towards each other. Also, bring the resonators R2 and R3 into closer relation against each other, and the connection coefficient between the resonators R1 and R4 changes so that the desired one as the polarized characteristics may be provided by the use of the change. As shown in FIG. 33, all the resonators R1 through R4 may be intersected. The case axial length may be made shorter than in the example shown in FIG. 17 so that the connection between the resonators R1 and R4 becomes stronger, thus ensuring more polarized band passing characteristics.

Figure 27:
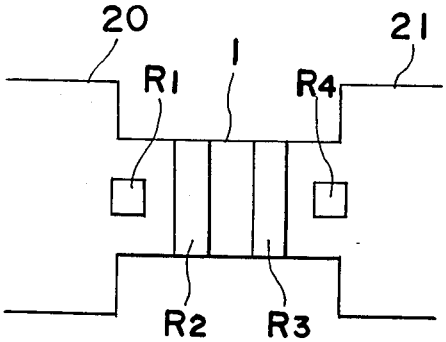
Figure 29:
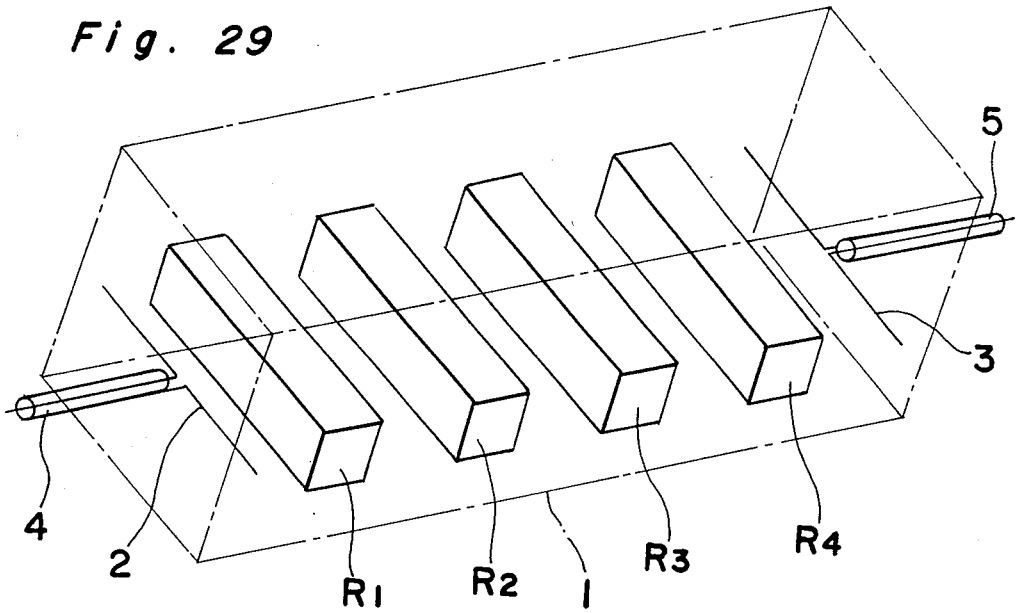
FIG. 29 is a perspective interior view in the conventional example.

FIG. 27 shows an input, output connection construction example with respect to the waveguide. For example, the magnetic-force lines of the TE10 mode which have been propagate through the waveguide 20 is coupled to the resonator R1, the magnetic force lines of the resonator R2 go into the waveguide 21 and are propagated in the TE10 mode.

Figure 28:
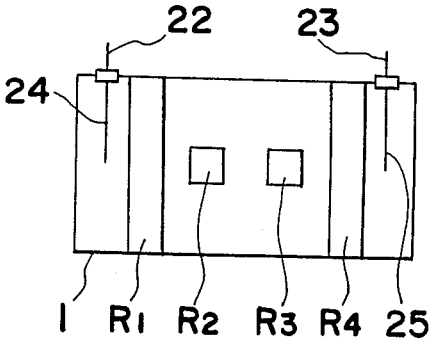
FIG. 28 is an interior view showing an embodiment, in which a pin terminal is used.

FIG. 28 shows the input, output connection construction using pin terminals. Both the pin terminal 22 on the input side and the pin terminal 23 on the output side are insulated from the case 1 and are respectively conductive wtih the connection rods 24, 25 within the case 1. Such construction as described hereinabove is convenient for incorporation in the MIC circuit base plate. It is to be noted that the coupling rods 24, 25 may be inserted into the resonators R1, R4 in such a case as described hereinabove.

As apparent from the above example, according to the present invention, the connection between the resonators is performed by the use of at least two intersecting TM modes so that the resonance apparatus for filters using the TM mode may be rendered smaller. The connection with the other resonator which was difficult to be performed in the conventional construction may be performed when the resonator is made smaller, so that the polarized filter may be easily provided.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A TM mode dielectric resonance apparatus comprising:

a case;

at least two TM mode dielectric resonators within the case;

one of said resonators being oriented in the case so as to resonate with a first mode having a magnetic field aligned in a first direction;

the other of said resonators being oriented in the case so as to resonate with a second mode having a magnetic field aligned in a second direction, such that the respective magnetic fields intersect each other; and means for coupling said two magnetic fields with respect to each other.

2. A TM mode dielectric resonance apparatus as described in claim 1, further comprising at least a third dielectric resonator relatively closer to said second resonator than to said first resonator, and said first resonator and said third resonator being magnetically connected, said connection providing polarized band passing characteristics.

3. A TM mode dielectric resonance apparatus as described in claim 2, wherein a connection degree of said connection between said first and third resonators is varied to provide desired polarized band passing characteristics.

4. A TM mode dielectric resonance apparatus as described in claim 3, wherein a magnetic connection of each adjacent pair of said resonators is provided by means on the case for influencing the respective magnetic fields of said resonators by a selected influence degree, so that the influence degree with respect to the even and odd modes to be produced by said two resonators may be rendered different.

5. A TM mode dielectric resonance apparatus as described in claim 4, wherein said means on the case comprises an indented portion of the case.

6. A TM mode dielectric resonance apparatus as described in claim 4, wherein said means on the case comprises a projecting portion of the case.

7. A TM mode dielectric resonance apparatus as described in claim 3, wherein a magnetic connection of each adjacent pair of said resonators is provided by a portion of said case having an irregular shape for influencing the respective magnetic fields of said resonators by a selected influence degree, so that the influence degree with respect to the even and odd modes to be produced by said two resonators may be rendered different.

8. A TM mode dielectric resonance apparatus as described in claim 3, wherein the resonators of each adjacent pair of resonators have different axial angles of orientation with respect to said case, said angles being selected for influencing the respective magnetic fields of said resonators by a selected influence degree, so that the influence degree with respect to the even and odd modes to be produced by said two resonators may be rendered different, and the angles further being selected to change the magnetic coupling coefficient to provide a desired value.

9. A TM mode dielectric resonance apparatus as described in claim 3, wherein said first and second resonators are rendered mutually different in length to change said connection degree between said first and third resonators.

10. A TM mode dielectric resonance apparatus as described in claim 2, wherein a magnetic connection of each adjacent pair of said resonators is provided by means on the case for influencing the respective magnetic fields of said resonators by a selected influence degree, so that the influence degree with respect to the even and odd modes to be produced by said two resonators may be rendered different.

11. A TM mode dielectric resonance apparatus as described in claim 10, wherein said means on the case comprises an indented portion of the case.

12. A TM mode dielectric resonance apparatus as described in claim 10, wherein said means on the case comprises a projecting portion of the case.

13. A TM mode dielectric resonance apparatus as described in claim 2, wherein a magnetic connection of each adjacent pair of said resonators is provided by a portion of said case having an irregular shape for influencing the respective magnetic fields of said resonators by a selected influence degree, so that the influence degree with respect to the even and odd modes to be produced by said two resonators may be rendered different.

14. A TM mode dielectric resonance apparatus as described in claim 2, wherein the resonators of each adjacent pair of resonators have different axial angles of orientation with respect to said case, said angles being selected for influencing the respective magnetic fields of said resonators by a selected influence degree, so that the influence degree with respect to the even and odd modes to be produced by said two resonators may be rendered different, and the angles further being selected to change the magnetic coupling coefficient to provide a desired value.

15. A TM mode dielectric resonance apparatus as described in claim 1, wherein a magnetic connection of each adjacent pair of said resonators is provided by means on the case for influencing the respective magnetic fields of said resonators by a selected influence degree, so that the influence degree with respect to the even and odd modes to be produced by said two resonators may be rendered different.

16. A TM mode dielectric resonance apparatus as described in claim 15, wherein said means on the case comprises an indented portion of the case.

17. A TM mode dielectric resonance apparatus as described in claim 15, wherein said means on the case comprises a projecting portion of the case.

18. A TM mode dielectric resonance apparatus as described in claim 1, wherein a magnetic connection of each adjacent pair of said resonators is provided by a portion of said case having an irregular shape for influencing the respective magnetic fields of said resonators by a selected influence degree, so that the influence degree with respect to the even and odd modes to be produced by said two resonators may be rendered different.

19. A TM mode dielectric resonance apparatus as described in claim 1, wherein the resonators of each adjacent pair of resonators have different axial angles of orientation with respect to said case, said angles being selected for influencing the respective magnetic fields of said resonators by a selected influence degree, so that the influence degree with respect to the even and odd modes to be produced by said two resonators may be rendered different, and the angles further being selected to change the magnetic coupling coefficient to provide a desired value.

20. A TM mode dielectric resonance apparatus as described in claim 1, wherein two TM mode dielectric resonators are integrally formed.

21. A TM mode dielectric resonance apparatus as described in claim 1, wherein two TM mode dielectric resonators are separately formed.

* * * * *